US006236331B1

(12) United States Patent
Dussureault

(10) Patent No.: US 6,236,331 B1
(45) Date of Patent: May 22, 2001

(54) LED TRAFFIC LIGHT INTENSITY CONTROLLER

(75) Inventor: Guy Dussureault, Montreal (CA)

(73) Assignee: Newled Technologies Inc., Montreal (CA)

( * ) Notice: Subject to any disclaimer, the term of this patent is extended or adjusted under 35 U.S.C. 154(b) by 0 days.

(21) Appl. No.: 09/252,789

(22) Filed: Feb. 19, 1999

Related U.S. Application Data

(60) Provisional application No. 60/075,418, filed on Feb. 20, 1998.

(51) Int. Cl.[7] ..... G08B 5/22

(52) U.S. Cl. ..... 340/815.45; 340/815.4; 340/907; 340/909; 340/916; 340/931; 362/800

(58) Field of Search ..... 340/815.45, 815.4, 340/907, 909, 916, 931; 362/800; 315/131, 158

(56) References Cited

U.S. PATENT DOCUMENTS

| | | | | |
|---|---|---|---|---|
| 3,757,511 | * | 9/1973 | Burgess et al. . | |
| 4,104,562 | * | 8/1978 | Dicola | 315/158 |
| 4,309,639 | | 1/1982 | Thrower, Jr. . | |
| 4,329,625 | | 5/1982 | Nishizawa et al. . | |
| 4,456,855 | | 6/1984 | Sairanen . | |
| 5,034,659 | | 7/1991 | Taniguchi . | |
| 5,113,131 | | 5/1992 | Cooper et al. . | |
| 5,248,967 | | 9/1993 | Daneshfar . | |
| 5,319,978 | * | 6/1994 | Grudzien, Jr. | 73/705 |
| 5,387,909 | | 2/1995 | Neel et al. . | |
| 5,457,450 | * | 10/1995 | Deese et al. | 340/912 |
| 5,661,645 | | 8/1997 | Hochstein . | |
| 5,783,909 | * | 7/1998 | Hochstein | 315/159 |
| 5,850,126 | * | 12/1998 | Kanbar | 315/200 A |

* cited by examiner

*Primary Examiner*—Julie Lieu
(74) *Attorney, Agent, or Firm*—Swabey Ogilvy Renault; James Anglehart

(57) ABSTRACT

The LED traffic light electronic controller stabilizes the total output light intensity of the traffic light in order to ensure a constant light intensity of each traffic light color throughout the entire traffic light lifetime. The controller detects the output light intensity of a color, and then automatically adjusts the power input for the LEDs in order to increase the light intensity when needed. The controller works in a closed loop cycle in order to perform real-time control of the light intensity output. Thus, at each moment of the traffic light lifetime, the output light intensity is constant and equivalent to a predetermined standard. This insures traffic safety for the entire traffic light lifetime and also make it last longer. The controller also provides a ballast load when off, and is able to provide an open circuit when the LEDs have exhausted their useful lifespan. The intensity is further controlled by detecting ambient light conditions.

11 Claims, 4 Drawing Sheets

LED TRAFFIC LIGHT INTENSITY CONTROLLER

The present application claims priority of U.S. provisional patent application Ser. No. 60/075,418 filed Feb. 20, 1998.

BACKGROUND OF THE INVENTION

1. Field of the Invention

The present invention relates to LED traffic lights, more particularly to LED traffic light intensity controllers.

2. Background of the Invention

Traditionally, traffic lights have used light bulbs in order to produce light. A colored filter was installed in front of each bulb for giving one of the three traffic lights common colors. However, traffic lights using this technology have many drawbacks: the bulbs power consumption is high (each being between 100 W and 150 W), thus increasing the operation costs, the bulb lifetime is short and decreases with environmental conditions. For example, a light bulb's lifetime decreases with vibrations and temperature.

In recent years, LED panel arrays were proposed for replacing traditional light bulbs for traffic light applications. Recent technologies that have been developed allow the generation of all the three colors needed in such an application (red, yellow and green). An LED traffic light uses only a fraction of the electrical power a light bulb traffic light used and is thus less expensive for long term use. However, LEDs employed for making up the array have a limited lifetime and their output light intensity also decreases with time. After a period of time, the total light intensity of a color (e. g. the traffic light red color) may drop below the standard minimum intensity required in order to insure traffic safety.

LED traffic lights are also sensitive to vibrations and shocks. Therefore, current technologies using LEDs in order to replace standard traffic light bulbs are neither reliable enough nor cost-efficient for being widely implemented.

SUMMARY OF THE INVENTION

It is therefore an object of the present invention to provide an LED traffic light electronic controller for stabilizing the total output light intensity of such a traffic light in order to insure a constant light intensity of each traffic light color throughout the entire traffic light lifetime. The controller detects the output light intensity of a color, and then automatically adjusts the power input for the LEDs in order to increase the light intensity when needed. The controller works in a closed loop cycle in order to perform real-time control of the light intensity output Thus, at each moment of the traffic light lifetime, the output light intensity is constant and equivalent to a predetermined standard. This insures traffic safety for the entire traffic light lifetime and also make it last longer.

Such a controller allows the LED traffic light to be more cost-efficient than standard traffic light bulbs. It insures above standard light intensity output for longer lifetime and does this using only 14 watts to 30 watts per color comparing to 100 watts to 150 watts for standard traffic lights.

It is another object of the present invention to provide the electronic controller completely encapsulated in an exothermic polymer compound. In this manner, each and every part of the controller is firmly fixed in a polymer block that eliminates any chance for that part to be removed from its place. The controller is thus protected against violent vibrations, shocks and failure due to dust and moisture intrusions that commonly affect circuit boards.

It is also an object of the present invention to provide a traffic light intensity controller that automatically puts out of service the traffic light at the end of its lifetime, by detecting an end-of-life sign, such as a too low light intensity output of the LEDs, a particular amount of time expired since the installing date or a too high electric current being fed to the LED matrix. When such a condition occurs, the traffic light controller may also send a failure signal to a traffic light emergency controller, which is a standard controller available on most traffic lights, so the emergency controller may switch the traffic light into an emergency mode, such as a blinking red light mode.

In another preferred embodiment of the present invention, the traffic light intensity controller also comprises an alternative load circuit that is powered alternatively with the LED matrix, i.e. when the LED matrix is turned off the alternative load is on, so the traffic light emergency circuit always detects a closed circuit, even when the light is off, and does not switches the traffic light to the emergency mode.

In a further preferred embodiment, the invention provides a controller for dimming the LED intensity at night, while providing maximum intensity during the brightest hours. Preferably, this is achieved using a photocell detecting ambient light conditions, although other ways such as a time of day circuit could be used.

BRIEF DESCRIPTION OF THE DRAWINGS

The present invention is described and will be better understood with reference to the following drawings.

DETAILED DESCRIPTION OF THE PREFERRED EMBODIMENTS

The preferred embodiment of the present invention is an electronic controller for traffic lights intended to maintain the total light intensity level of each color at a constant level during the whole traffic light lifetime.

The controller 10 has the purpose of controlling the input voltage of the LEDs composing the color of the traffic light At the beginning of the LEDs life, they individually output greater light intensity, thus producing a higher total light output for a given input voltage. But with time, LEDs lose their brightness and some of them even fail to operate so the total light intensity drops. The present controller detects the actual light intensity in real-time and correct the LEDs input voltage for "extracting" more light from the working LEDs. In this manner, the total light intensity is kept constant at every moment and the LEDs matrix 11 does not have to be changed so often, because with the present invention, it may comply with the standard for a longer period of time.

Figure 1:
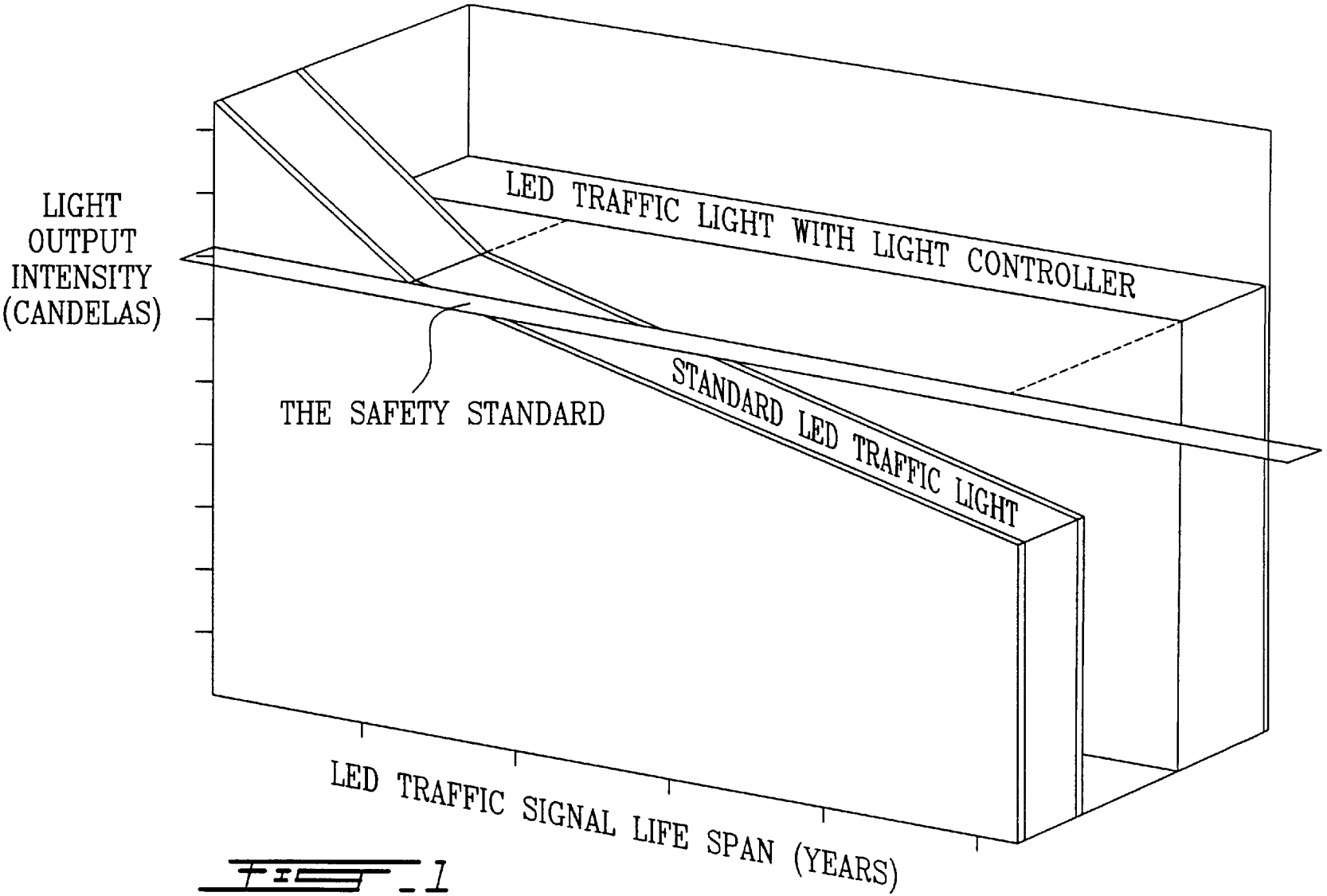
FIG. 1 illustrates the difference between a standard LED traffic light and an LED traffic light comprising an electronic light intensity controller.
Figure 2:
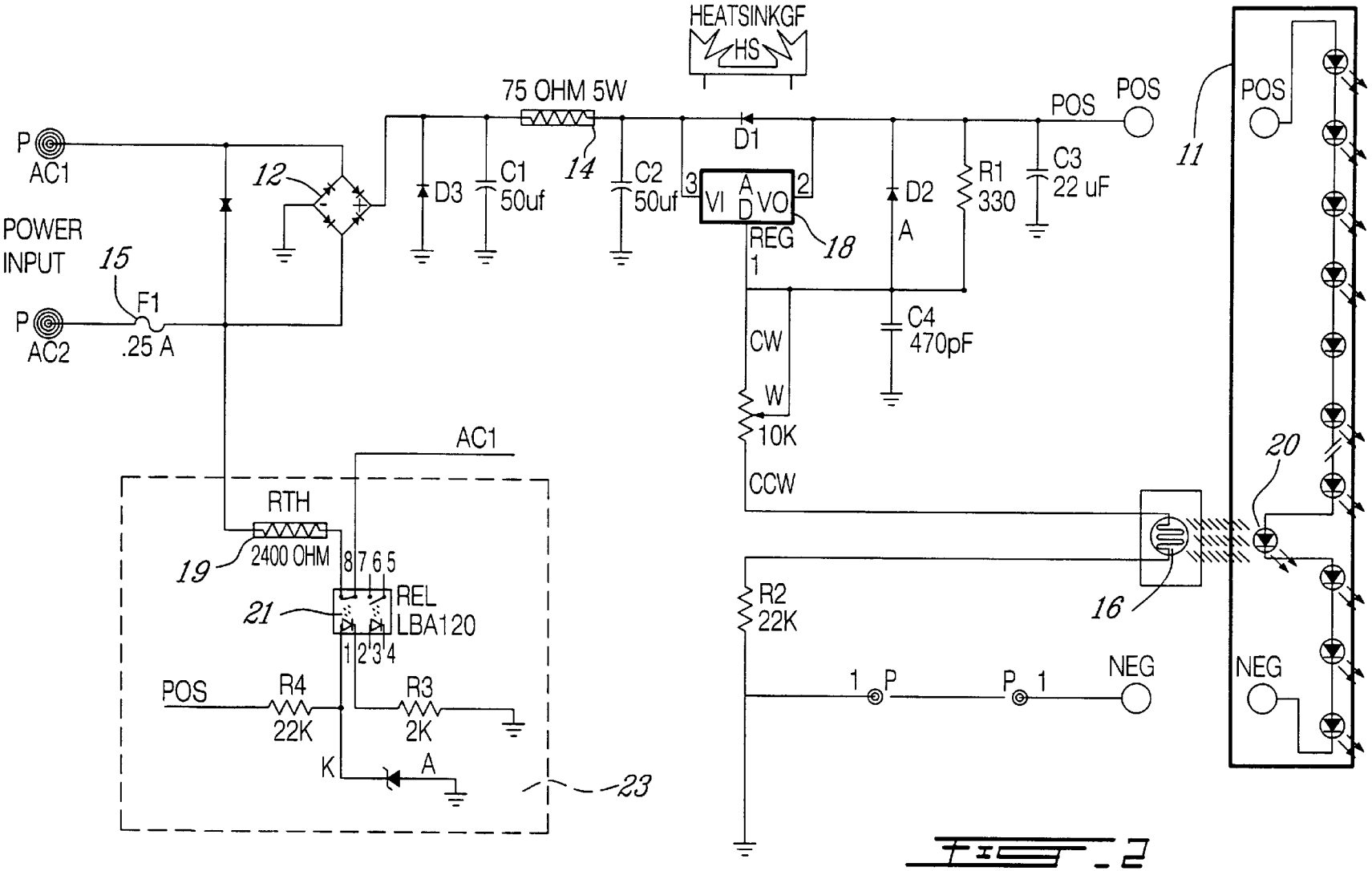
FIG. 2 shows the electronic circuit of the traffic light electronic controller according to a preferred embodiment of the invention.

FIG. 1 shows the difference between a standard LED traffic light and an LED traffic light comprising a light intensity controller such as the one disclosed in the present application. It can be seen that a standard LED traffic light looses light intensity over the years because of the LEDs light output degradation. Such a standard LED traffic light has to be set to output a higher intensity of light at the beginning, fact that results in lost energy for that period. Since its light intensity drops with time, after a number of years, that traffic light does not outputs anymore a sufficient level of light that would comply with the safety standard. On the other side, a traffic light comprising an LED light intensity controller is able to output a constant level of light throughout its whole lifetime and does so at a fraction of the energy consumption of a standard traffic light The electronic circuit of the present controller may be the one represented in FIG. 2. The circuit may be powered from the power grid at 120 V, but other voltages may be used as well with little modifications to the circuit. A diode bridge 12 may be used in order to rectify the AC signal and to transform it into a rectified but non-regulated DC signal having a voltage varying from about 115 V to 130 V at location 14. The optical detector 16 is a light sensitive cell that transforms the captured light intensity into a voltage which is then input into pin 1 of transistor 18. The transistor 18 is a voltage regulator and may be considered the core of the circuit. It is preferably an LM317HVT transistor and its object is to control an output voltage on pin 2 depending on the input voltage received on pin 1 and which represents the light intensity, by being powered on pin 3 by a voltage around 120 V. The output voltage on pin 2 of transistor 18 is intended to control the output light intensity of a number of LEDs, preferably connected in parallel, in order to maintain it at a constant level, over the application standard light intensity level. For example, when the light sensitive cell 16 detects a lower level of light, it outputs a higher level of voltage toward the control pin 1 of the transistor 18. Upon receiving of that higher voltage, the transistor 18 outputs a higher voltage on its output pin 2, thus creating a greater voltage for the LEDs which will increase their light intensity output.

This is a closed-loop cycle since the LEDs light intensity control is performed continuously and in real time. It will be appreciated that, in the preferred embodiment, the extra LED is located behind the panel of LEDs inside of the traffic light housing. It would of course be possible to place the light detector on the front side of the panel in optical coupling with the extra LED which could form part of the any of LEDs.

In another preferred embodiment of the present invention, the traffic light controller circuit 10 comprises an alternative load 19 and a relay 21 which form an alternative load circuit 23. This circuit 23 is used for simulating a load when the LED array is not fed with current simply because the traffic light is off. This is required in order to avoid that the traffic light emergency controller, which is a protection circuit available on most traffic lights, puts the traffic light into an emergency mode (the red light will blink), which usually occurs when an open circuit is detected (the traffic light bulb is burned). The relay 21 is open when the traffic light is ON, so the alternative load 19 is out of the circuit at this moment because the circuit is feeding the LED array with current. But when no more power is detected at the output of the controller 10 (the LED array is turned off), then the relay 21 closes the alternative circuit 23 and the load 19 becomes the single load fed by the circuit. A little current 17 still passes through the circuit and this causes the emergency controller not to detect an open circuit which would have resulted in an emergency state of the traffic light.

In a preferred embodiment of the present invention, the controller 10 comprises a protection fuse 15 whose purpose is to open the circuit when the input current becomes too high. This is a condition that usually occurs toward the end of life of the LEDs, when they are deteriorated to a point that much more current is needed for outputting the same level of light. When such a condition occurs, the electrical current 17 increases and burns fuse 15. The maximum current accepted by the fuse 15 may vary depending on the operating conditions of the controller circuit. For example, if the circuit is exactly the one shown in FIG. 2, the maximum current 17 accepted by the fuse 15 without burning is 0.25 A. When such a condition occurs and the current level 17 burns the fuse 15, the alternative load circuit 23 is not activated since no more electric current enters the controller. At this point, the emergency controller, which is a standard circuit available on most traffic lights, detects an open circuit and switches the traffic light into an emergency mode which may be, for example, a blinking red light.

Figure 3:
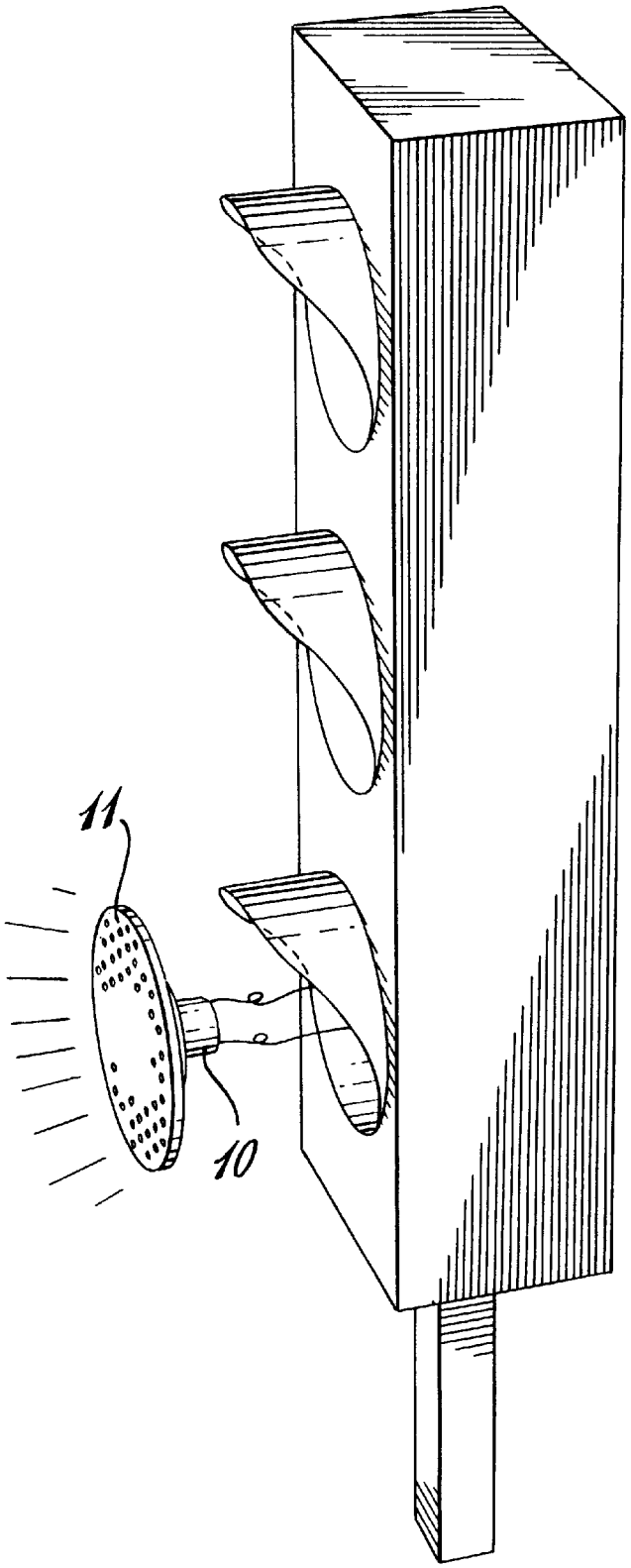
FIG. 3 shows the LED traffic light with a light intensity controller attached to the back side of the LED array.

In another preferred embodiment of the invention, the controller 10 is attached to the back side of the LED matrix 11, as shown in FIG. 3. Instead of capturing the total LEDs' light, it captures only the light of a single (or a few) LED 20, which is turned around in order to illuminate toward the controller's light sensitive cell 16. This LED 20 is connected to the same circuitry as the others LEDs and thus suffers the same light intensity degradation over time. It is then possible to consider the single LED light output degradation as being representative of the total light degradation and only use that single LED 20 as an input for the light intensity controller 20.

The quality of the LEDs used in a traffic light may vary from one brand name to the other. It is known in the industry that Hewlett Packard LEDs are the most reliable LEDs available on the market. Therefore, a single Hewlett-Packard LED may be enough for representing the totality of LEDs without a significant risk that it will fail. However, when other brand names of LEDs are used, up to 5 LEDs must be turned toward the controller light sensitive cell and used for representing correctly the totality of the LEDs used for creating the traffic light color.

In a preferred embodiment of the present invention, the LEDs are connected in parallel instead of being connected in series with each other, for avoiding that the failure of a single LED results in the failure of all LEDs.

In another preferred embodiment of the present invention, all electronic components of the controller 10 may be encapsulated into a polymer block. The result of this encapsulation is that controller failures due to shocks and temperature are practically completely eliminated, because the components are solidly hold inside the polymer block.

Figure 4:
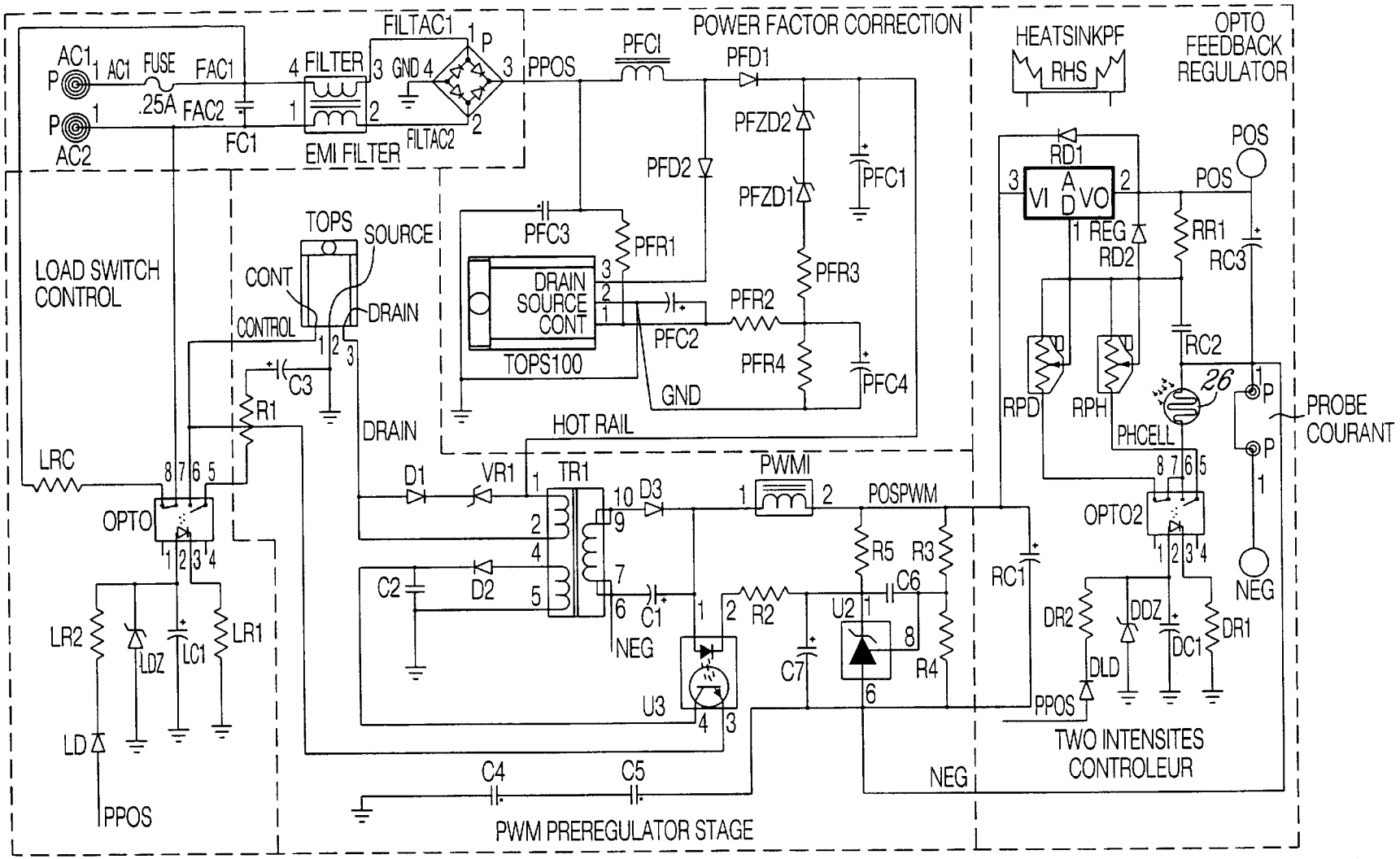
FIG. 4 is a circuit diagram of the traffic light electronic controller according to a second preferred embodiment having an intensity level adjustment for day/night conditions.

FIG. 4 shows a circuit diagram of a further preferred embodiment in which a photocell 26 is provided an arranged to be exposed to ambient light outside the traffic light. The photocell 26 responds to ambient light and causes the brightness of the LED array to drop from the normal controlled brightness when dim or dark ambient conditions are present. In this preferred embodiment, the life of the LEDs is extended by not being operated at full brightness for at least about one half of the time.

It is to be understood that the circuitry provided with the present application represents only the preferred embodiment of the present invention. Other variants of the invention may be used as well in order to control the power input to a LED array with the purpose of controlling the total light intensity output of that LED array. Moreover, in the present application one or few diodes are used in order to provide to the light controller a measure of the light level output by the whole LED array; other variants, such as inputting the total light level directly to the controller's light sensitive cell may be used as well.

What is claimed is:

1. An LED traffic light panel comprising:

an array of LEDs having a similar performance to one another which performance decays over an extended period of operational time;

a variable power supply connected to said array of LEDs;

an extra LED having also a similar performance to said LEDs of said array;

a light detector optically coupled to said extra LED; and a controller circuit for adjusting said variable power supply in response to an output of said light detector, whereby an output light intensity of the traffic light panel is stabilized over the life of said LEDs in order to insure a constant light intensity of each traffic light color throughout the entire traffic light panel lifetime.

2. The light panel as claimed in claim 1, further comprising:

said power supply receives a power signal from a traffic light controller unit; and a circuit responsive to a voltage supplied to said array of LEDs for disconnecting a load from said power signal when said voltage indicates that said array of LEDs have a performance which has decayed to a predetermined limit, such that said power signal will meet an open circuit at said panel, whereby said traffic light controller unit recognizes the traffic light panel as "burnt out" once the performance has decayed to said limit.

3. The light panel as claimed in claim 1, wherein:

said power supply receives a power signal from a traffic light controller unit; and said controller circuit also detects said power signal and connects a shunt load to said power signal when said power signal is in an off-state and disconnects said shunt load when said power signal is in an on-state, whereby said controller unit will not detect an open circuit when in an off-state and thus disable the traffic light.

4. The light panel as claimed in claim 2, wherein:

said controller circuit also detects said power signal and connects a shunt load to said power signal when said power signal is in an off-state and disconnects said shunt load when said power signal is in an on-state, whereby said controller unit will not detect an open circuit when in an off-state and thus disable the traffic light.

5. The light panel as claimed in claim 1, wherein:

said array of LEDs are mounted to one side of a board;

said power supply, said extra LED, said light detector, and said controller circuit are mounted to another side of said board; and said LEDs, said power supply, said extra LED, said light detector, and said controller circuit being completely encapsulated in a transparent polymer compound.

6. The light panel as claimed in claim 5, wherein said polymer compound is exothermic.

7. The light panel as claimed in claim 1, further comprising means for generating a light intensity signal by detection of at least one of time of day and ambient light, wherein said controller circuit further adjusts said variable power supply in response to said light intensity signal.

8. The light panel as claimed in claim 2, further comprising means for generating a light intensity signal by detection of at least one of time of day and ambient light, wherein said controller circuit further adjusts said variable power supply in response to said light intensity signal.

9. The light panel as claimed in claim 3, further comprising means for generating a light intensity signal by detection of at least one of time of day and ambient light, wherein said controller circuit further adjusts said variable power supply in response to said light intensity signal.

10. The light panel as claimed in claim 1, further comprising:

a light sensitive device arranged to receive ambient light and generate a light intensity signal;

wherein said variable power supply is responsive to said intensity signal and connected to said array of LEDs for adjusting a brightness of said LEDs depending on said ambient light.

11. An LED traffic light panel comprising;

an array of LEDs;

a power supply receiving a power signal from a traffic light controller unit and supplying power to said array of LEDs, said power supply having an impedance which appears as an open circuit to said controller unit when said power signal is in an off-state; and a controller circuit for detecting said power signal and connecting a shunt load to said power signal when said power signal is in an off-state and disconnecting said shunt load when said power signal is in an on-state, whereby said controller unit will not detect an open circuit when in an off-state and thus disable the traffic light.

* * * * *